United States Patent [19]

Stambaugh et al.

[11] 4,036,367

[45] July 19, 1977

[54] ROTATABLE SHOE RACK

[76] Inventors: Sherwood C. Stambaugh, 9453 State Route 43, Streetsboro, Ohio 44240; Marie K. Hephner, 3881 W. Valley Drive, Fairview Park, Ohio 44126

[21] Appl. No.: 732,539

[22] Filed: Oct. 14, 1976

[51] Int. Cl.[2] ..... A47F 5/02; A47F 7/08

[52] U.S. Cl. ..... 211/37; 211/163

[58] Field of Search ..... 211/37, 163, 131, 78, 211/144; 108/103, 139

[56] References Cited

U.S. PATENT DOCUMENTS

| | | | |
|---|---|---|---|
| 1,762,185 | 6/1930 | Mendle | 211/163 |
| 2,973,867 | 3/1961 | Cohen | 211/37 |
| 3,266,634 | 8/1966 | Tintary | 211/131 |
| 3,452,880 | 7/1969 | Kovacik et al. | 211/163 X |

FOREIGN PATENT DOCUMENTS

| | | | |
|---|---|---|---|
| 740,227 | 11/1955 | United Kingdom | 211/37 |

*Primary Examiner*—Ramon S. Britts

*Attorney, Agent, or Firm*—Hamilton, Renner & Kenner

[57] ABSTRACT

A shoe rack or tree comprising wire racks tiered one above another and independently rotatable on a central column supported on a base. The racks are separated by spacer sleeves encircling the column and a disk cover is mounted on the upper end of each spacer sleeve for covering over the wire rack below.

8 Claims, 5 Drawing Figures

ROTATABLE SHOE RACK

BACKGROUND OF THE INVENTION

Prior shoe rack constructions of which we are aware have been unsatisfactory and objectionable for a number of reasons. Certain prior racks have not been rotatable and hence shoes stored thereon are not easily accessible, particularly when the rack is used in a closet or the like. Other prior racks have been made adjustable as to capacity, but these lack stability. Still other prior tiered rotary racks have required bodily turning the whole rack heavily laden with shoes to make a selected pair accessible.

In all prior constructions known to us which have racks tiered one above another there has been no provision for shielding the shoes on one tier from the dust and dirt dropping on and into the shoes below, which by the very nature of shoes is inevitable.

SUMMARY OF THE INVENTION

The present improved tiered rotatable shoe tree is inexpensive to manufacture, light in weight and overcomes the difficulties presented by prior constructions.

It is an object of the present invention to provide a simple and compact rotatable shoe tree having tiered wire racks which are independently rotatably mounted on a central column.

Another object is to provide a rotatable shoe tree having improved circular wire racks rotatably mounted on a central column for supporting shoes in side-by-side relation.

A further object is to provide an improved shoe tree having tiered racks rotatable on a central column with a separate cover spaced above and extending over each rack.

Another object is to provide an improved rotatable shoe tree which is quickly and easily assembled and disassembled.

A still further object is to provide an improved shoe tree having spaced spacer sleeves frictionally mounted on the central column for supporting the racks and covers and permitting independent rotation of the racks.

These and other objects are accomplished by the improved parts and combinations comprising the present invention, a preferred embodiment of which is shown by way of example in the accompanying drawings and described in detail in the following specification. Various modifications and changes in details of construction are comprehended within the scope of the appended claims.

DESCRIPTION OF A PREFERRED EMBODIMENT

Figure 1:
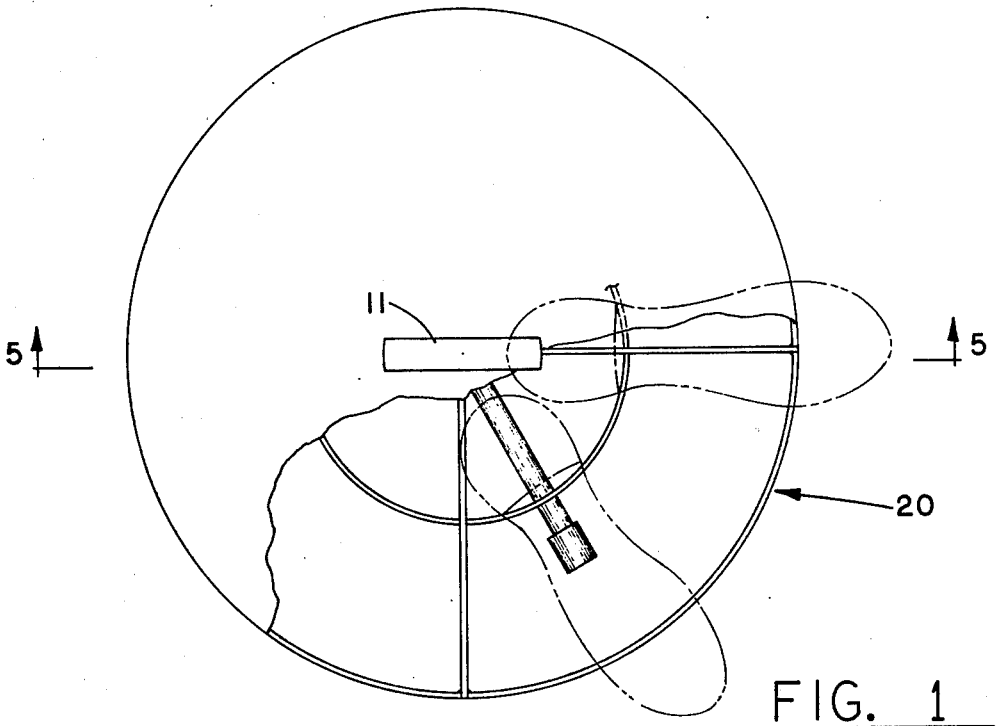
FIG. 1 is a top plan elevation, partly broken away, of the improved shoe tree.
Figure 2:
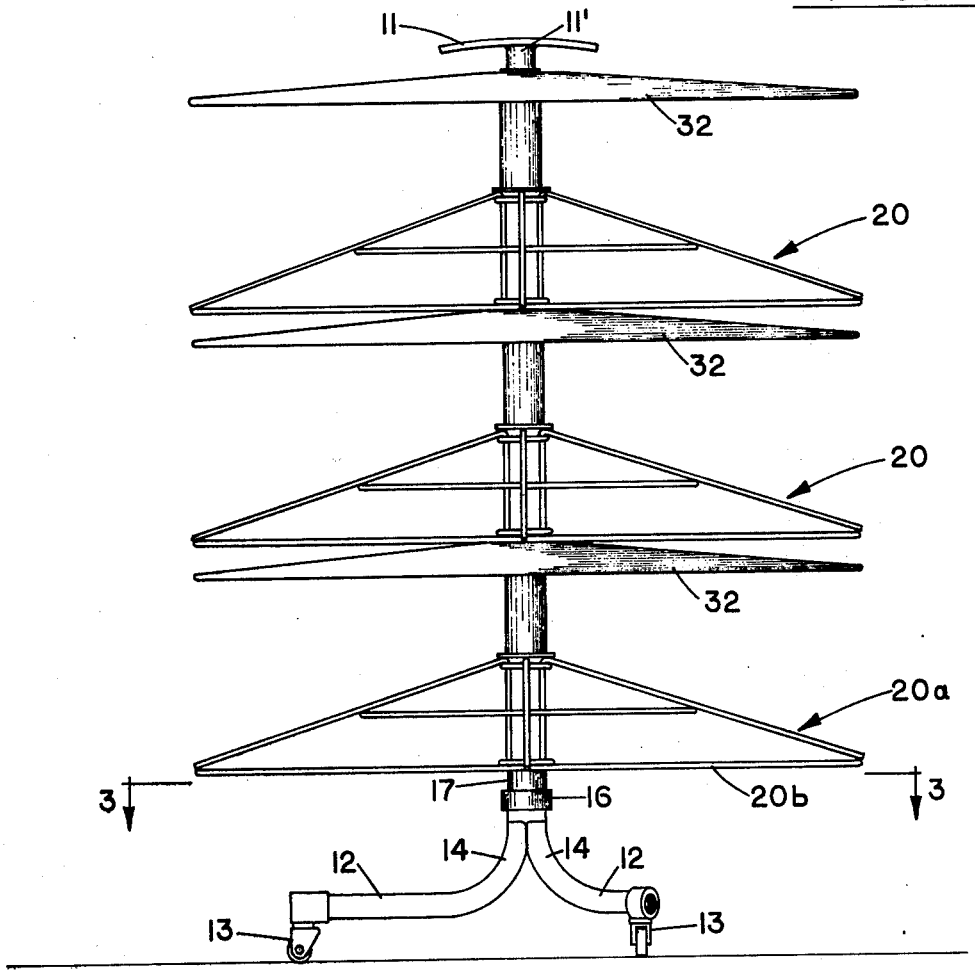
FIG. 2 is a side elevation thereof.
Figure 3:
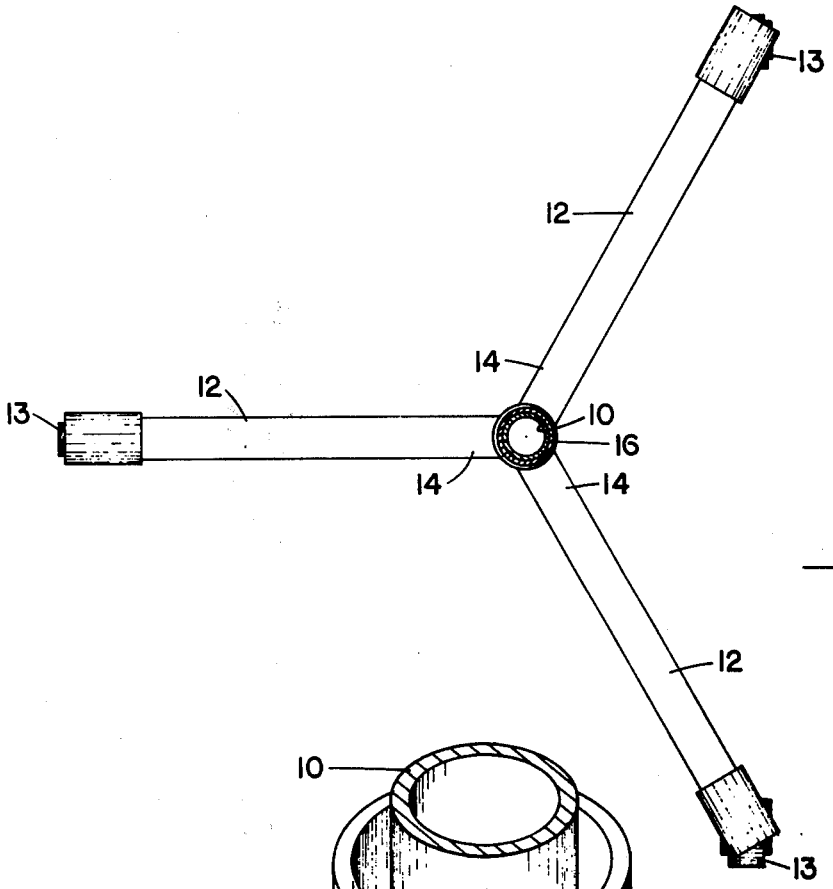
FIG. 3 is an enlarged plan sectional view on line 3—3 of FIG. 2.

The vertical column 10 of the improved shoe tree is preferably a metal tube having a handle 11 secured to its top end. The handle preferably has a stub 11' which is secured in the top of column 10. The bottom end of the column 10 is supported on a base comprising tubular legs having radial outer portions 12 preferably supported on casters 13 at their outer ends and upwardly curved inner portions 14 which embrace the column 10 at their upper ends. Three tubular legs 12 at 120° spacings are shown but the number may be varied as desired.

Figure 4:
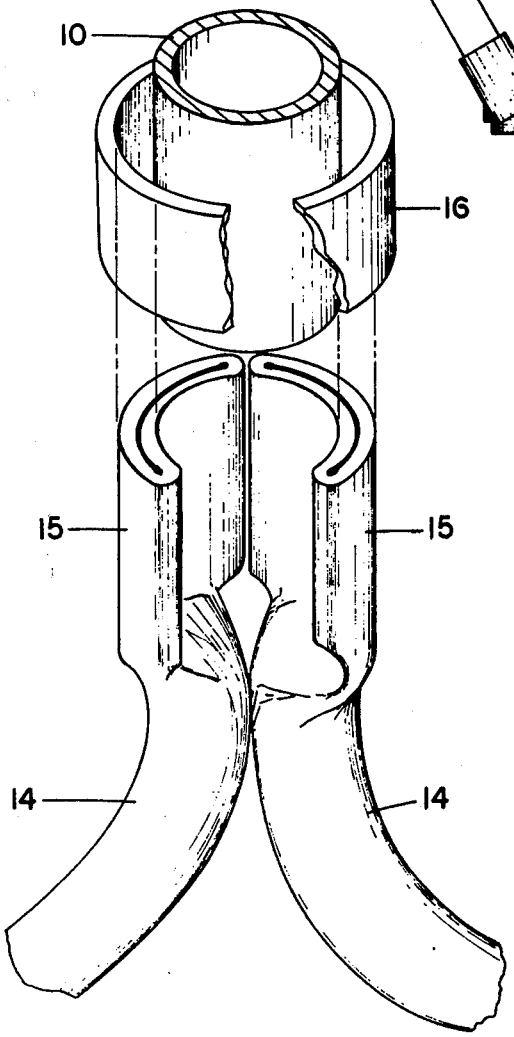
FIG. 4 is an enlarged exploded perspective view showing how the central column is supported on the legs of the base.

As best shown in FIG. 4, the upper ends of the portions 14 may have flattened arcuate flanges 15 formed thereon which substantially conform to the exterior of the column. Preferably, the flanges 15 have a slight exterior taper to wedgably receive a locking sleeve 16 to clamp the flanges 15 tightly around the column 10. A short spacer tube 17 of suitable plastic material having a friction fit on the column 10 may be provided above sleeve 16 to support the lowermost rack on the column 10.

Figure 5:
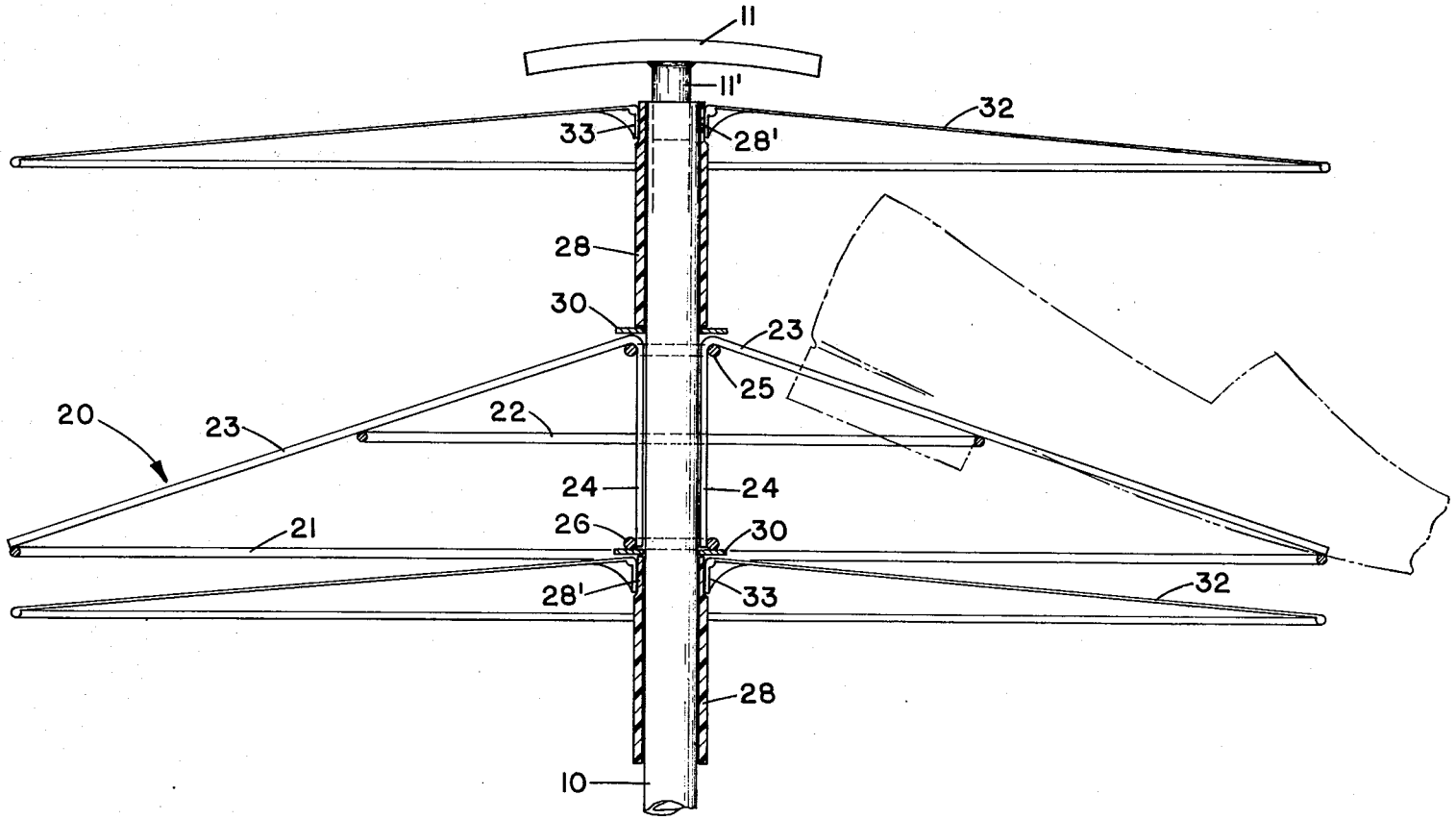
FIG. 5 is an enlarged fragmentary vertical sectional view, as on line 5—5 of FIG. 1.

Three wire racks are each indicated generally at 20, but it will be understood that the number of racks may be varied as desired. The construction of each of the racks is identical except for a bottom shelf on the lowermost rack. As seen in FIG. 5, each rack 20 preferably comprises a circular bottom horizontal outer ring 21 and a concentric horizontal inner ring 22 spaced above ring 21. The rings 21 and 22 are connected by inclined radially disposed spokes 23 which are welded or soldered at their outer ends to ring 21 and at intermediate locations to inner ring 22. Four spokes 23 at 90° spacings are shown but the number and spacing may be varied.

The relationship of the inner ring 22 to the outer ring 21 is such that shoes may be supported on the racks with their heels hooked over the inner ring 22 and the front of the soles resting on the outer ring 21, as indicated in phantom in FIGS. 1 and 5.

Each of the wire spokes 23 is bent downwardly at its inner end to form a vertical hub portion 24 extending parallel to the column 10, and upper and lower rings 25 and 26, respectively, encircle the hub portions 24 to position them closely adjacent to but spaced from the column 10, so that each rack is freely rotatable independently around the column.

The lowermost rack **20*a* preferably has a bottom shelf 20*b* which is flat and made of substantially heavy, solid plastic material and the inner ring 22** may be omitted, for a purpose to be described.

Spacer sleeves 28 of plastic material encircle the column 10 with a friction fit and extend between the racks 20 and **20*a* and above the topmost rack. Preferably, bearing washers 30 are interposed between the tops and bottoms of the racks 20 and the spacer sleeves. Thus a washer 30 supports the bottom ring 26 of the lowermost rack on the upper end of spacer sleeve 17 and washers 30 are interposed between the spacer sleeves 28** and the tops and bottoms of the racks. The friction fit of the sleeves on the column ensures that each rack can be rotated independently without rotating the other racks.

Each rack 20 and **20*a* has a disk cover 32 spaced above it and extending over the rack. The covers 32 are preferably circular and made of a semi-rigid thermoplastic material and are preferably slightly conical in cross section. Each disk has a cylindrical hub 33** adapted to fit tightly over a reduced diameter upper end portion 28' of a sleeve 28, so that the disks are firmly and stably supported on the column in proper spaced relation to the rack below, the uppermost disk being supported on the upper end portion of the top sleeve 28. The top of column 10 projects a short distance above the uppermost disk to receive the handle stub 11'. The bottom shelf **20*b* of the lowermost rack 20*a* is adapted to support heelless shoes, bedroom slippers and the like which would tend to slide off the racks 20.**

It will be apparent that the improved rotatable shoe tree is quickly assembled without the aid of tools by applying the locking sleeve 17 over the flanges 15 of the base legs and then sliding the spacer sleeves, washers, racks and covers over the column in proper order. Disassembly is just as easily accomplished in reverse order.

The improved rotatable shoe tree is inexpensive, lightweight and has independently rotatable wire racks for maximum accessibility to all shoes supported on the racks, while the individual covers for the racks insure that the shoes stored thereon are protected from dust and dirt at all times.

We claim:

1. A rotatable shoe rack comprising a base, a vertical column supported on the base, at least two vertically spaced wire racks independently rotatably mounted on said column, said racks having concentric wire rings at different levels for supporting shoes in side-by-side positions, said rings connected to radial spokes having vertical hub portions rotatable on said column, spacer sleeves tightly and non-rotatably fitting the column above each of said hub portions, and disk covers supported on the upper ends of said spacer sleeves and extending over the racks immediately below.

2. A rotatable shoe rack as defined in claim 1, wherein additional wire rings are connected to and encircle the top and bottom ends of said hub portions.

3. A rotatable shoe rack as defined in claim 2, wherein bearing washers are interposed between the ends of said spacer sleeves and the top and bottom ends of said hub portions.

4. A rotatable shoe rack as defined in claim 1, wherein the base comprises radial legs secured at their inner ends to the column and supported at their outer ends on casters.

5. A rotatable shoe rack as defined in claim 4, wherein the base comprises radial legs secured at their inner ends to the column and supported at their outer ends on casters.

6. A rotatable shoe rack as defined in claim 1, wherein the lowermost rack has a bottom shelf for supporting heelless shoes and the like.

7. A rotatable shoe rack as defined in claim 1, wherein the hub portions comprise wire extensions of said spokes.

8. A rotatable shoe rack as defined in claim 1, wherein a handle is mounted on the top end of the column.

* * * * *

UNITED STATES PATENT OFFICE

CERTIFICATE OF CORRECTION

PATENT NO. : 4,036,367

DATED : July 19, 1977

INVENTOR(S) : Sherwood C. Stambaugh and Marie K. Hephner

It is certified that error appears in the above-identified patent and that said Letters Patent are hereby corrected as shown below:

Column 1, line 44, delete "spaced."

Column 4, line 17, change the numeral "4" to -- 2 --.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*